US007395005B2

(12) United States Patent
Takada et al.

(10) Patent No.: US 7,395,005 B2
(45) Date of Patent: Jul. 1, 2008

(54) IMAGE FORMING APPARATUS WITH CLEANING BLADE AND RESIDUAL TONER STORAGE COMPARTMENT

(75) Inventors: Mikihiko Takada, Hino (JP); Shigetaka Kurosu, Hino (JP); Hiroshi Morimoto, Akiruno (JP); Satoshi Nishida, Saitama (JP); Kazuteru Ishizuka, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 303 days.

(21) Appl. No.: 11/132,046

(22) Filed: May 18, 2005

(65) Prior Publication Data

US 2006/0034632 A1 Feb. 16, 2006

(30) Foreign Application Priority Data

Aug. 10, 2004 (JP) ..... 2004-233130

(51) Int. Cl.
*G03G 15/16* (2006.01)
*G03G 21/00* (2006.01)
*G03G 21/12* (2006.01)

(52) U.S. Cl. ..... 399/101; 399/350; 399/360

(58) Field of Classification Search ..... 399/101, 399/123, 349, 350, 358, 360
See application file for complete search history.

(56) References Cited

U.S. PATENT DOCUMENTS

| | | | | |
|---|---|---|---|---|
| 5,349,429 | A * | 9/1994 | Jugle et al. | 399/346 |
| 5,442,422 | A * | 8/1995 | Owens et al. | 399/103 |
| 6,587,666 | B2 * | 7/2003 | Kato et al. | 399/350 |
| 6,694,122 | B2 * | 2/2004 | Muto et al. | 399/350 |
| 7,082,284 | B2 * | 7/2006 | Nishida et al. | 399/346 |
| 7,127,201 | B2 * | 10/2006 | Takenouchi et al. | 399/297 |
| 2003/0054269 | A1 * | 3/2003 | Yamazaki et al. | 430/45 |
| 2005/0078991 | A1 * | 4/2005 | Kimura et al. | 399/350 |
| 2005/0180773 | A1 * | 8/2005 | Morimoto et al. | 399/101 |

FOREIGN PATENT DOCUMENTS

JP 11-038778 2/1999

* cited by examiner

*Primary Examiner*—Robert Beatty
(74) *Attorney, Agent, or Firm*—Lucas & Mercanti, LLP

(57) ABSTRACT

An image forming apparatus, comprising an image carrier to carry toner image formed based on image data, a cleaning blade to remove residual toner on the image carrier by being in contact with the image carrier and a toner storage portion structured to store the residual toner removed by the cleaning blade and so that the image carrier can rub on the residual toner, wherein the toner storage portion is located on an upstream side of a contacting point between the cleaning blade and the image carrier in a moving direction of the image carrier and in a position where the toner storage portion is not in contact with the cleaning blade.

9 Claims, 2 Drawing Sheets

IMAGE FORMING APPARATUS WITH CLEANING BLADE AND RESIDUAL TONER STORAGE COMPARTMENT

This application is based on Japanese Patent Application No. -2004-233130 filed on Aug. 10, 2004 in Japanese Patent Office, the entire content of which is hereby incorporated by reference.

BACKGROUND OF THE INVENTION

The present invention relates to image forming apparatuses using the electro-photographic method, such as copiers, printers, facsimile machines and apparatuses combining these functions, and in particular, relates to a technique to improve durability of these apparatuses by preventing filming on the photosensitive drum or on the intermediate image transfer belt, or damage to the edge of the cleaning blade.

The blade cleaning method is known which is a cleaning method used in image forming apparatuses configured to form a toner image on a photosensitive drum employing various means for charging, exposure, and development around the drum, then either directly transferring the toner image onto the recording material (sheet of paper), or temporarily transferring the toner images from plural photosensitive drums onto an intermediate image transfer belt and then conducting a secondary transfer of the toner image on the belt onto a recording material. In order to remove any residual toner remaining on the photosensitive drums or on the intermediate image transfer belt (both of which are collectively called an image carrier) after the images have been transferred, commonly arranged is a cleaning blade made of an elastic material such as urethane which presses against the image carrier in the direction counter to the direction of movement of the image carrier.

Recently, increased printing rate and higher durability are required of an image forming apparatuses, and image defects have become problems, such as image striations and unevenness caused by filming of the photosensitive drum or the intermediate image transfer belt, as well as cleaning defects caused by wear or damage to the edge of the cleaning blade. Filming is caused by adhesion of lubricants such as calcium stearate (CaSt) and zinc stearate (ZnSt), or wax included in the toner onto the image carrier, and the electrical image transfer field of the adhered portion is weakened because the surface resistance there becomes higher. Further, because the adhesion force between the toner and the intermediate image transfer belt becomes stronger on the adhered portion, it becomes hard to remove the toner from the intermediate image transfer belt. For these reasons, the decrease of transferring performance on the adhered portions causes striation or unevenness of the image. Further, portions where filming appears raise their frictional drag and, hence the edge of the cleaning blade is scratched and bent on the surface of the intermediate image transfer belt, resulting in damage to the cleaning blade edge.

Lubricants are added into the toner to improve smoothness of the cleaning blade, and wax is added into the toner to improve separability of the recording material after the fixing process.

There is a tendency that more filming or damage occurs on the edge of the cleaning blade on intermediate image transfer belts than on photosensitive drums. The reason is considered to be because the surface of the intermediate image transfer belt is harder than that of the photosensitive drum and is hard to shave off. This condition makes it easier for materials such as the toner to adhere and accumulate on the surface of the intermediate image transfer belt.

As a countermeasure against these problems, a well-known technique to eliminate filming is to polish the image carrier.

Another well-known technique is to improve lubrication or polishing effect between the image carrier and the cleaning blade which reduces frictional drag by forming a toner band in areas other than the image area, which supplies adequate toner to the edge of the cleaning blade during non-imaging operation.

Further, to prevent bending of the cleaning blade by reducing frictional factors between the cleaning blade and the intermediate image transfer belt, there is an image forming apparatus which is structured to scrape off the residual toner adhering to the intermediate image transfer belt, and stores a part of the residual toner in a storage portion and further scoops up the toner for re-adhesion to the intermediate image transfer belt with a brush roller (for example, see Patent Document 1).

[Patent Document 1] Official Gazette of Japanese Patent Tokkaihei No. 11-38778

The image carrier may be polished with emery paper, non-woven fabric including abrasive particles or a lapping film by contact of these materials with the rotating image carrier. However, problems of the emery paper or the non-woven fabric include abrasive particles easily causing damage to the image carrier, and further lapping film which has a fine mesh easily becomes clogged and the polishing effect does not last long even though it is very effective for a short time.

When a toner band is formed on an area other than the image area on the intermediate image transfer belt, another problem is that if the toner band is formed between successive sheets of paper, the toner band adheres to the transfer roller and stains the back of the sheet. A structure considered to be effective is one which retracts the transfer roller while the toner band passes near the roller to prevent staining, however, in case of high speed machines, no enough time can be secured for the retraction, and therefore, forming the toner band causes adverse effects during the normal image forming operation, and further the number of the finished copies per unit time decreases, and still further consumption of toner increases.

Yet further, according to the image forming apparatus described in Patent Document 1, the residual toner is re-supplied to the intermediate image transfer belt. Unless the contacting load of the cleaning blade against the intermediate image transfer belt is increased, a problem occurs that the residual toner slips under the edge of the cleaning blade, however if the contacting load is increased another problem occurs that the edge is easily worn.

SUMMARY OF THE INVENTION

This invention was created in consideration of this problem and an objective of this invention is to provide an image forming apparatus, which can reduce the contacting load on the cleaning blade and damage to its edge and can greatly improve durability of the blade related to leakage of toner slipping under the edge of the cleaning blade and the occurrence of filming.

The above objective can be achieved by the following apparatus.

(A) An image forming apparatus., comprising an image carrier to carry a toner image formed based on image data, a cleaning blade to remove residual toner on the image carrier. by being in contact with the image carrier and a toner storage portion structured to store the residual toner removed by the cleaning blade and so that the image carrier can slide on the residual toner, wherein the toner storage portion is located on an upstream side of a contacting point between the cleaning blade and the image carrier in a moving direction of the image carrier and in a position where the toner storage portion is not in contact with the cleaning blade.

(B) An image forming apparatus, comprising an intermediate image transfer belt to carry a toner image formed based on image data, a cleaning blade to remove residual toner on the intermediate image transfer belt by being in contact with the intermediate image transfer belt, a toner storage portion structured to store the residual toner removed by the cleaning blade and so that the intermediate image transfer belt can be rubbed on the residual toner and paired first and second rollers to pinch the intermediate image transfer belt on the upstream side of a contacting point between the cleaning blade and the intermediate image transfer belt in a rotational direction of the intermediate image transfer belt, wherein the intermediate image transfer belt and the first roller form parts of walls of the toner storage portion.

In the image forming apparatus described above, because the image carrier is rubbed on the residual toner accumulated in the residual toner storage portion, both the contacting load of cleaning blade against the image carrier and damage to the edge of the cleaning blade can be reduced, and durability of the cleaning blade is greatly increased related to leakage of toner slipping under the edge of the cleaning blade and the occurrence of filming.

DETAILED DESCRIPTION OF THE PREFERRED EMBODIMENT

An explanation regarding the image forming apparatus of this invention will now be given referring to figures.

First, an example of image forming apparatuses forming color images will be explained referring to FIG. 1, which is a cross sectional view of the image forming apparatus. This invention is not only used for color image forming apparatuses but also for ones forming monochrome images.

Figure 1:
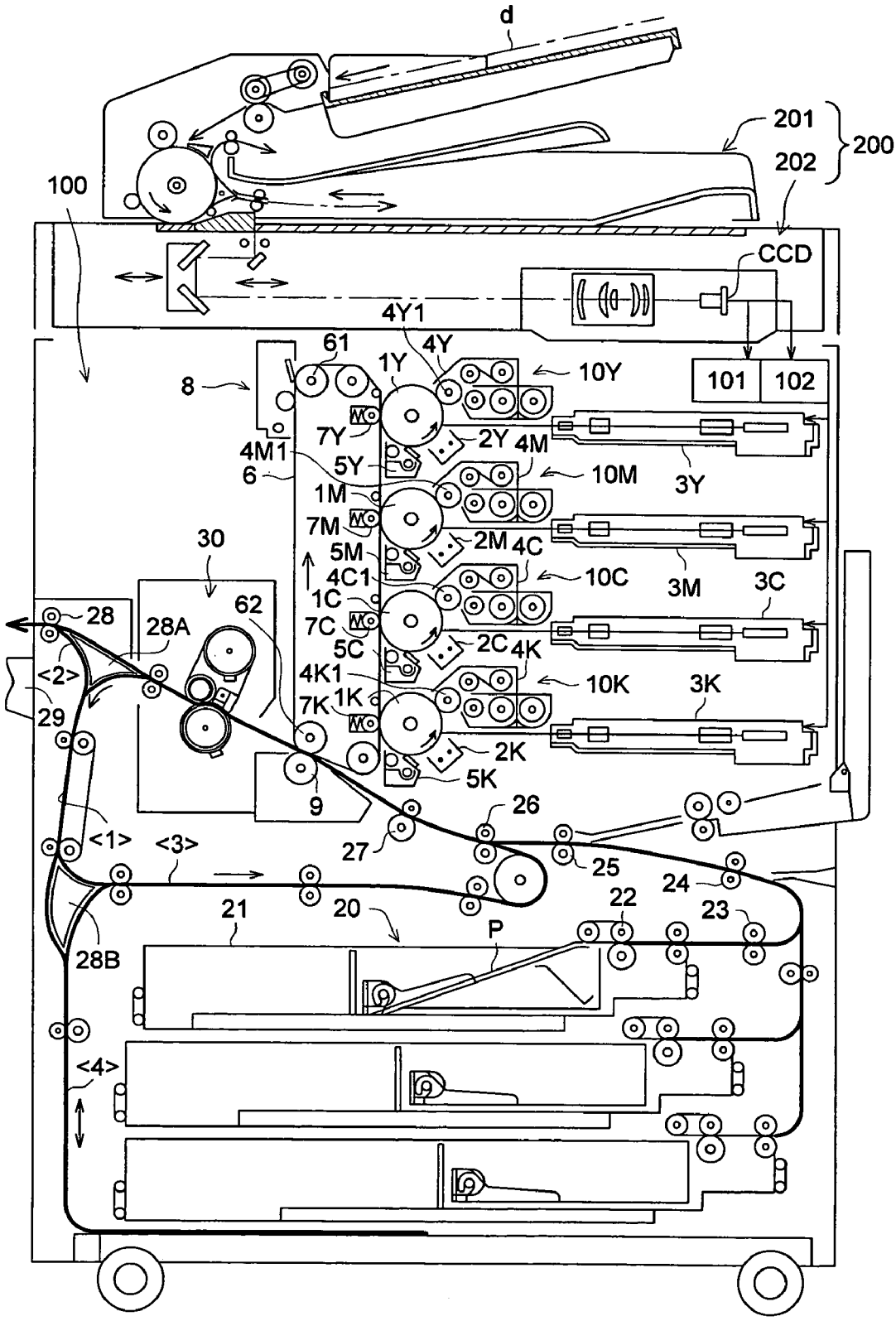
FIG. 1 is a cross sectional view showing the structure of the image forming apparatus.

The color image forming apparatus shown in FIG. 1 is composed of image forming apparatus 100 and image reading apparatus 200.

Image forming apparatus 100 is of the type called tandem type color image forming apparatus and is composed of plural sets of image forming means 10Y, 10M, 10C, and 10K, belt-shaped intermediate image transfer body 6, paper conveying device 20, and belt fixing device 30.

On the upper portion of image forming apparatus 100, image reading device 200 is installed, composed of automatic document feeder 201 and document image scanning exposure device 202.

Document "d" loaded on the document platen of automatic document feeder 201 is conveyed by a conveying means and scanning exposure is applied to the image on one side or to the images on both sides of document "d" by an optical system of document image scanning exposure device 202, and then a line image sensor CCD reads the image or images.

Analog signals which have been photoelectrically transduced by the line image sensor CCD are analog-processed, A/D converted, processed with shading correction and image compression in image-processing section 101, and 102 and then inputted into exposure means 3Y, 3M, 3C and 2K.

Image forming section 10Y which forms the yellow portions of images is composed of photosensitive drum 1Y which serves as an image carrier, charging means 2Y which is installed at the periphery of photosensitive drum 1Y, exposure means 3Y, developing means 4Y, cleaning device 5Y and primary transfer roller 7Y which serves as the primary transfer means, etc.

Image forming section 10M which forms the magenta portion of images is composed of photosensitive drum 1M which serves as an image carrier, charging means 2M which is installed at the periphery of photosensitive drum 1M, exposure means 3M, developing means 4M, cleaning device 5M and primary transfer roller 7M which serves as the primary transfer means, etc.

Image forming section 10C which forms the cyan portion of images is composed of photosensitive drum 1C which serves as an image carrier, charging means 2C which is installed at the periphery of photosensitive drum 1C, exposure means 3C, developing means 4C, cleaning device SC and primary transfer roller 7C which serves as the primary transfer means, etc.

Image forming section 10K which forms the black portion of images is composed of photosensitive drum 1K which serves as an image carrier, charging means 2K which is installed at the periphery of photosensitive drum 1K, exposure means 3K, developing means 4K, cleaning device 5K and primary transfer roller 7K which serves as the primary transfer means, etc.

Developing means 4Y, 4M, 4C, and 4K are provided with developing rollers 4Y1, 4M1, 4C1, and 4K1 which are toner carriers of a cylindrical shape at, for example, a thickness of 0.5-1 mm and an external diameter of 15-25 mm. That are made of non-magnetic stainless steel or aluminum, respectively containing dual component toners (however single component toner may also be used) made of toners of the colors yellow (Y), magenta (M), cyan (C), or black (K) that have been electrically charged of the same polarity as the charging polarity of photosensitive drums 1Y, 1M, 1C, and 1K.

Developing rollers 4Y1, 4M1, 4C1, and 4K1 are maintained at a specific spacing, for example, 100-1000 micrometers, from respective photosensitive drums 1Y, 1M, 1C, and 1K in a non-contacting manner by projecting rollers (not shown in the figure) and are rotated in the same feeding direction as the rotation of photosensitive drums 1Y, 1M, 1C, and 1K.

During development, reversal development is carried out of the electrostatic latent image on photosensitive drums 1Y, 1M, 1C, and 1K by applying a development bias voltage that is either a DC voltage or an AC voltage superimposed on a DC voltage to developing rollers 4Y1, 4M1, 4C1, and 4K1 of the same polarity as that of the toners.

In general, a so-called external additives are added to the toners for the purpose of improving the flowability and the cleaning characteristics, and among these lubricants that are related to the present invention are higher fatty acid salts of metals such as, for example, stearates of zinc, aluminum, copper, magnesium, calcium, etc., oleates of zinc, manganese, iron, copper, magnesium, etc., palmitates of zinc, copper, magnesium, calcium, etc., linoleates of zinc, calcium, etc., ricinoleates of zinc, calcium, etc.

The percentage of addition of these external additives is about 0.01-10% by weight relative to the toner.

Intermediate image transfer belt 6 is a semi-conductive endless belt and is rotated clockwise by an un-illustrated motor, winding around a plurality of backup rollers 61 and 62.

Primary transfer rollers for each color 7Y, 7M, 7C, and 7K are provided opposite to photosensitive drums 1Y, 1M, 1C, and 1K sandwiching intermediate image transfer belt 6.

By applying a DC voltage at a polarity opposite to that of the polarity of the charge on the toner to primary transfer rollers 7Y, 7M, 7C, and 7K thereby forming an electrical image transfer field in the transfer region, the toner images of respective colors formed on photosensitive drums 1Y, 1M, 1C, and 1K are transferred as a primary image transfer onto intermediate image transfer belt 6.

Secondary image transfer roller 9 is provided opposite backup roller 62 for secondary image transfer sandwiching intermediate image transfer belt 6.

By applying a DC voltage at a polarity opposite to that of the polarity of the charge on the toner to secondary image transfer roller 9 thereby forming an electrical image transfer field in the transfer region, the superimposed toner images formed on intermediate image transfer belt 6 are transferred as a secondary image transfer onto the surface of recording material (sheet of paper) P.

Recording material P is supplied from paper feed cassette 21 by paper feed means 20, passes through plural intermediate rollers 22, 23, 24, 25, 26 and paired registration rollers 27, and is then conveyed to the secondary image transfer position where the color image is transferred onto it in a single operation.

Further, when changing to a different size of recording material P, the configuration is such that the length perpendicular to the paper conveying direction (the paper width) is changed using the center of intermediate image transfer belt 6 as reference.

Recording material P after the color image has been transferred onto it is subjected to a fixing operation by fixing device 30 and is placed on ejected paper tray 29 after being pinched between paper ejection rollers 28.

Cleaning device 8 which removes the residual toner remaining on intermediate image transfer belt 6 is provided downstream of the secondary image transfer position in the direction of rotation of intermediate image transfer belt 6. Details of cleaning device 8 will be described later.

Here, explanation will be given about the component materials of intermediate image transfer belt 6, primary image transfer roller 7 and secondary image transfer roller 9 in the present preferred embodiment of the present invention.

Intermediate image transfer belt 6 is an endless belt with a volume resistivity of $10^6$~$10^{12}$ Ω·cm, and usually the material used for it is, for example, a resin material such as polycarbonate (PC), polyimide (PI), polyamideimide (PAI), polyvinylidenefluoride (PVDF), ethylene-tetrafluoroethylene copolymer (ETFE), or rubber materials such as EPDM, NBR, CR, polyurethane, etc., in which a conductive filler such as carbon, etc., is dispersed or which contains ionic conductive materials. The thickness of this belt is desirably set at about 50-200 μm in the case of resin materials and at about 300-700 μm in the case of rubber materials.

Primary image transfer rollers 7Y, 7M, 7C, and 7K are formed, for example, by coating the peripheral surface of a conductive metal core (not shown in the figure) made of such as stainless steel, etc., having an external diameter of about 8 mm, with a covering of semi-conductive elastic rubber (not shown in the figure) at a thickness of 5 mm, a rubber hardness of about 20-70° (Asker hardness C). The covering is also in the solid state or in a foam sponge state with a volume resistivity of about $10^5$-$10^9$Ωcm and made of a material such as polyurethane, EPDM, silicone rubber, etc., in which a conductive filler such as carbon has been dispersed or which contains an ionic conductive material.

Secondary image transfer roller 9 is formed, for example, by coating the peripheral surface of a conductive metal core (not shown in the figure) made of stainless steel etc., having an external diameter of about 8 mm, with a covering of semi-conducting elastic rubber (not shown in the figure) at a thickness of 5 mm, a rubber hardness of about 20-70° (Asker-C) The covering is either a solid or in a foam sponge exhibiting a volume resistivity of about $10^5$ to $10^9$ Ω·cm and structured of a material such as polyurethane, EPDM, silicone rubber, etc., in which conductive filler such as carbon has been dispersed or which contains an ionic conductive material.

Unlike primary image transfer rollers 7Y, 7M, 7C, and 7K, secondary image transfer roller 9 comes into contact with the toner, so that there are cases where a coating of semi-conductive fluorine-based resin or urethane resin, etc. is used as its surface, which have superior mold separation characteristics. Backup roller 62 for secondary image transfer is formed, for example, by coating the peripheral surface of a conductive metal core (not shown in the figure) made of stainless steel, etc., with a covering of semi-conductive rubber (not shown in the figure) such as polyurethane, EPDM, silicone rubber, etc., in which a conductive filler such as carbon has been dispersed or which contains an ionic conductive material, at a thickness in the range of 0.05-0.5 mm.

Next, the image forming process will be explained.

When image recording is started, the drive motor (not shown in the figure) of photosensitive drum 1Y starts and photosensitive drum 1Y of yellow (Y) image forming section 10Y is rotated counter-clockwise as shown with an arrow in FIG. 1, and at the same time the electrical potential of photosensitive drum 1Y starts to increase due to the charging action of charging section 2Y.

After charging of photosensitive drum 1Y is completed, printing of the image of the first color is started by exposure means 3Y via electrical signals corresponding to the image data for (Y), and the (Y) parts of the static electricity latent image are formed on the surface of photosensitive drum 1Y. The electrostatic latent image is applied with a reversal development by developing roller 4Y1, either in a contacting or non-contacting state, and the yellow (Y) toner image portions are formed on the photosensitive drum 1Y via its rotation.

The toner image formed on photosensitive drum 1Y is transferred onto intermediate image transfer belt 6 by primary image transfer roller 7Y.

Subsequently, in synchronization with the (Y) toner image on intermediate image transfer belt 6, the magenta (M), cyan (C), and black (K) toner images are formed by being successively superimposed on the previously formed color image portion, thereby creating a color toner image.

After the image has been transferred, any residual toner remaining on the peripheral surfaces of photosensitive drums 1Y, 1M, 1C, and 1K is removed by cleaning devices 5Y, 5M, 5C, and 5K.

In synchronization with the formation of the color toner image on intermediate image transfer belt 6, recording material P which is separated and conveyed one sheet at a time from paper feed cassette 21 and conveyed via paired paper feed rollers 22, 23, 24, 25 and 26 and paired registration rollers 27, and the color toner image on intermediate image transfer belt 6 is transferred in a single operation onto recording material P by secondary image transfer roller 9.

The electrostatic charge on recording material P onto which the color toner image has been transferred is discharged by the discharging means (not shown in the figure), and recording material P is conveyed to fixing device 30, and is ejected onto ejected paper tray 29 by paired paper ejection rollers 28 after the toner has been fixed by means of heat and pressure.

On the other hand, any residual toner remaining on the peripheral surface of intermediate image transfer belt 6 after completed image transfer is removed by cleaning device 8.

When recording material P is applied with reversal discharge after the image has been fixed, first, recording material P is conveyed through the right passage of switching plate 28A which is located between belt fixing device 30 and paired paper discharge rollers 28. Then, after being fed downward into first conveying passage <1>, recording material P is reversed through second conveying passage <2> located on the left side of switching plate 28A and discharged outside via paired paper discharge rollers 28.

When double side copying is to be carried out on recording material P, first, an image formed on the first side of recording material P is processed and fixed, and after recording material P has passed through first conveying passage <1>, and further into the fourth conveying passage <4> under switching plate 28B, it is reversed into the third conveying passage <3> through passage on the right side of switching plate 28B and further fed upward to be conveyed by paired paper feed rollers 26. Image portion of each color are formed on the second surface of recording material P by image forming means 10Y, 10M, 10C and 10K, and is then heat-fixed by belt fixing device 30 and recording material P is discharged outside the apparatus by paired paper discharge rollers 28.

Next, detailed structure and the result of the experiments regarding cleaning device 8 related to this invention will be explained.

Figure 2:
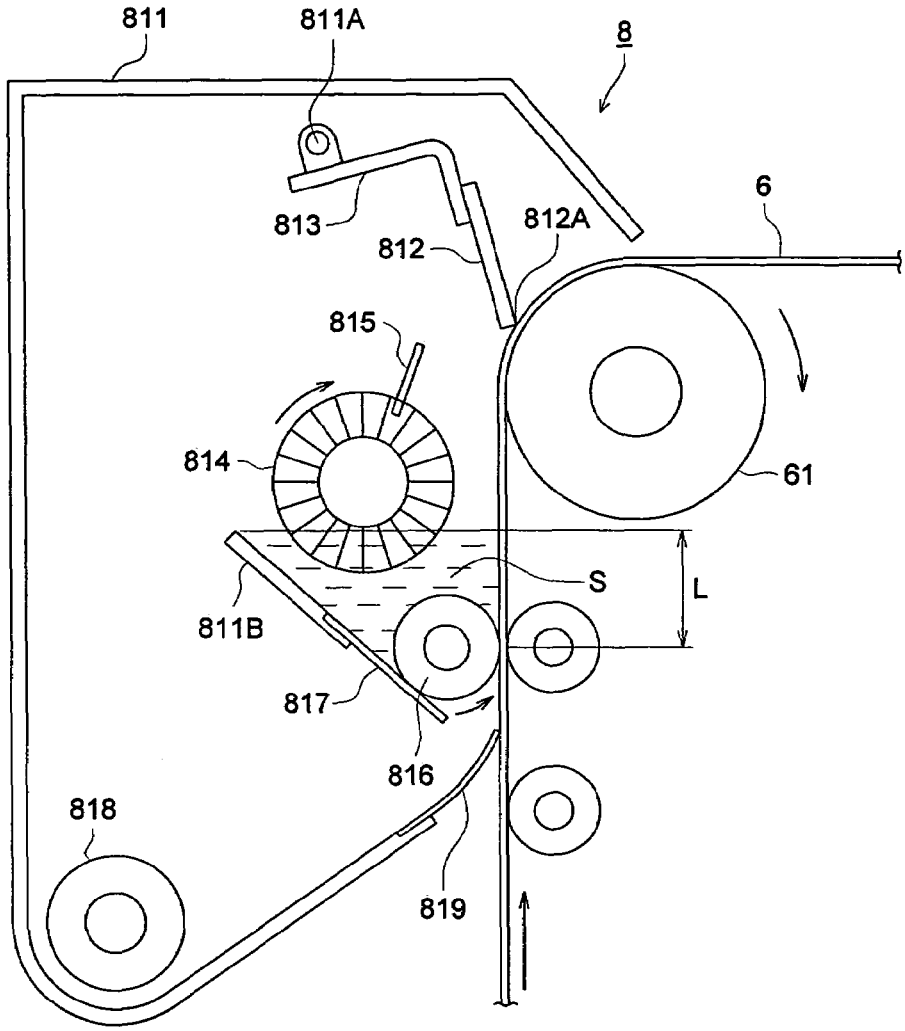
FIG. 2 is a cross sectional view of the main parts of the cleaning device.

FIG. 2 is a cross sectional view of main parts of the cleaning device.

Numeral 811 represents a casing which encloses all members composing the cleaning device.

Numeral 812 represents a cleaning blade composed of an elastic material such as polyurethane and is fixed to blade holder 813 with adhesive. Blade holder 813 is pivoted on supporting shaft 811A installed on casing 811 and urged by a spring (not illustrated) counterclockwise. Accordingly, edge 812A of cleaning blade 812 presses on intermediate image transfer belt 6 supported by back-up roller 61 so that edge 812A is oriented in the opposite direction (counter direction) of the rotation of intermediate image transfer belt 6.

Numeral 814 represents a brush roller having brushes on its surface and is located near intermediate image transfer belt 6 without being in contact with the belt, on the upstream side of the contacting point between edge 812 of cleaning blade 812A and intermediate image transfer belt 6 in the rotational direction of intermediate image transfer belt 6. Brush roller 814 is rotated in the opposite direction by a rotating means (not illustrated) against the moving direction of intermediate image transfer belt 6. That is, both brush roller 814 and intermediate image transfer belt 6 rotate clockwise in FIG. 2.

Numeral 815 represents a flicker made of a resin plate or a stainless steel plate, etc., one end of which is fixed to casing 811 and the other end is in contact with brush roller 814.

Numeral 816 in FIG. 2 represents a sponge roller located under brush roller 814 and rotates counterclockwise following intermediate image transfer belt 6.

Numeral 817 represents a sealing plate made of stainless steel plate, etc., one end of which is fixed to part 811B attached to casing 811 and the other end presses against sponge roller 816.

Residual toner storage portion S to store residual toner is formed of part 811B of casing 811, sealing plate 817, sponge roller 816 and intermediate image transfer belt 6, which is rubbed on residual toner in residual toner storage portion S while the belt travels upward. The rubbing length is represented by L.

Numeral 818 represents discharge screw installed at the bottom of casing 811, which is rotated via an un-illustrated drive source.

Numeral 819 represents a sealing plate made of PET, etc., one end of which is fixed to casing 811 and the other end presses against intermediate image transfer belt 6 to avoid leakage of used toner.

In the cleaning device as structured above, residual toner remaining after transferring toner for an image onto recording material P by transfer roller 9, adheres to intermediate image transfer belt 6 and travels along with it. More specifically, intermediate image transfer belt 6 is first rubbed on residual toner accumulated in residual toner storage portion S. Any residual toner adhering to intermediate image transfer belt 6 is, then scraped off by cleaning blade 812 and the removed toner falls into residual toner storage portion S.

As described above, by rubbing between the intermediate image transfer belt 6 and the residual toner accumulated in residual toner storage portion S, some residual toner and toner patches formed for image stabilizing control on intermediate image transfer belt 6, also are rubbed on the accumulated residual toner, and therefore the residual toner adhering to intermediate image transfer belt 6 reduces its adhesion force or is removed into residual toner storage portion S, which results in improving cleaning performance of cleaning blade 812. Further, the residual toner accumulated in residual toner storage portion S polishes the surface of intermediate image transfer belt 6 working as an abrasive, therefore, even deposits other than residual toner are also removed from intermediate image transfer belt 6, resulting in avoiding the occurrence of filming.

Because the lower part of brush roller 814 is submerged into the residual toner in storage portion S, brush roller 814 picks up toner and flicker 815 sprinkles some residual toner from brush roller 814 onto intermediate image transfer belt 6 (being residual toner supplying means). As described above, by means of supplying the residual toner onto intermediate image transfer belt 6 upstream of cleaning blade 812 in the belt rotating direction, lubrication performance of cleaning blade 812 is improved resulting in decrease of damage to edge 812A and further polishing on edge 812A is carried out, whereby filming is reduced.

When residual toner fills residual toner storage portion S, the residual toner spills over from the left end and the substantially same amount of residual toner is always maintained in residual toner storage portion S. The spilt residual toner is conveyed with discharging screw 818 perpendicular to the paper on which the figure is shown and is discharged to the outside of cleaning device 8 into a specified container.

If residual toner fills residual toner storage portion S, no toner comes in contact with cleaning blade 812 and stuffing of residual toner or leakage of residual toner slipping under edge 812A of cleaning blade 812 does not occur.

Next, to be explained will be an experiment which was conducted to research the contacting load of cleaning blade 812, the damage ratio of edge 812A of cleaning blade 812, existence of leakage of residual toner slipping under edge 812A, and occurrence of filming.

(1) Apparatus for Experiment

Experimented machine: a tandem full color copier shown in FIG. 1 with a cleaning device structured as shown in FIG. 2.

Photosensitive drum: 60 mm in diameter and coated with polycarbonate dispersed by phthalocyanine pigment as an organic semiconductor layer, and the thickness of the photosensitive layer including a charge transport layer is 25 μm.

Voltage of photosensitive body non-imaging portion: detected by a potential sensor, controlled by a feedback system within a controllable range of −500 to −900 V.

Total exposure voltage: −50 to 0 V

Exposure: laser scanning system at a power of the semiconductor laser of 300 μW.

Development: dual component developing system

Intermediate image transfer body: seamless semiconductive resin belt structured of polyimide with a rotating speed of 220 mm/s, a surface resistivity of $1\times10^{11}$ Ω/□, a volume resistivity of $1\times10^{8}$ Ω·cm, and a tension of 50 N.

Intermediate image transfer body driving roller: 30 mm

Primary image transfer means: a foam roller (diameter 20 mm, resistance $1\times10^{6}$ Ω) is installed on the back of the intermediate image transfer body and a prescribed current selected from a current table of matrix created by data of temperature and humidity, is applied.

Primary image transfer electrical conducting member: An electrical conductive roller at a roller pressure of 5 N Secondary image transfer means: structured so that the intermediate image transfer belt is pinched by a backup roller and a secondary image transfer roller, both at a resistance of $1\times10^{7}$ Ω, and to which a prescribed current selected from a current table of matrix created by data of temperature and humidity is applied.

Toner: emulsion polymerization toner, at a particle diameter of 6.5 μm, with the added lubricant amounting to (as a percentage by mass) Y: 0.15, M: 0, C: 0 and BK: 0.05

Cleaning blade:

Material: polyurethane rubber, (thickness 2 mm, free length 9 mm)

Contacting angle: 17 degrees.

Spring loading type: added load being 16 N/m

Brush roller

Material: electrically-conductive acrylic fiber Fiber diameter: 6.25 d (d means denier which is a unit of linear density as a scale of thickness of fiber, and a fiber length of 9,000 m at 1 g mass is defined as 1 denier.)

Density: 100,000 fibers/inch$^2$

Fiber length (loop height): 4.25 mm

Cored bar: 9 mm

Outer diameter: 17.5 mm

Rotating surface speed: 80 mm/sec

Gap to the intermediate image transfer belt: 2 mm (2) The Results of the Experiment

[Item 1] The Contacting Load of the Cleaning Blade a. The Evaluation Method

A toner image of 0.7 mg/cm$^2$ was formed in an A3 size area and transferred to intermediate image transfer belt 6 as a primary transfer, and then fed to cleaning blade 812 without secondary transfer. Evaluated was the existence of leakage of residual toner slipping under edge 812A of cleaning blade 812 while varying the contacting load of cleaning blade 812 against intermediate image transfer belt 6 as well as rubbing length L over which intermediate image transfer belt 6 is rubbed on residual toner accumulated in residual toner storage portion S. A cleaning blade with a wastage amount of 30 μm was employed.

b. The Evaluation Results

They are shown in Table 1.

TABLE 1

| Cleaning blade contacting load | Rubbing length L | | | No residual toner |
|---|---|---|---|---|
| (N/m) | 5 mm | 3 mm | 1 mm | storage portion |
| 8 | C | C | C | C |
| 10 | A | A | C | C |
| 12 | A | A | B | C |
| 16 | A | A | A | A |
| 20 | A | A | A | A |

Here,
A: No leakage of residual toner was observed.
B: Slight leakage of residual toner was observed.
C: Obvious leakage of residual toner was observed.

As a result, if the contacting load of cleaning blade 812 decreases, in case of no application of residual toner storage portion S or of excessively short rubbing length L, there was leakage of residual toner slipping under edge 812A of cleaning blade 812. Accordingly, providing rubbing length of 3-5 mm is desired.

[Item 2] Damage to the Edge of the Cleaning Blade

Evaluation Method

The damage ratio of edge 812A of cleaning blade 812 was evaluated if residual toner storage portion S was installed or not as well as if residual toner was resupplied with flicker 815 or not. Rubbing length L was 5 mm.

The edge damage ratio is calculated by the following formula.

The edge damage ratio=damage width×100/measured length of cleaning blade

Figure 3:
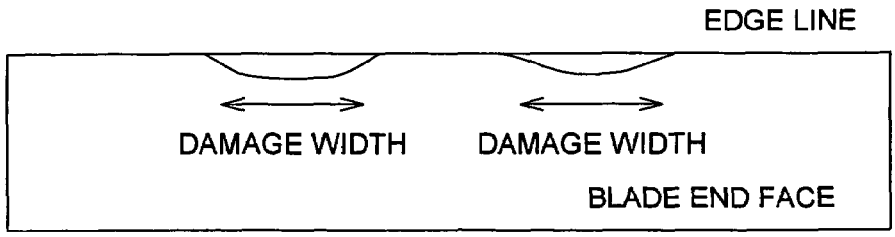
FIG. 3 is a view showing the damage width on the edge of the cleaning blade.

The damage width is as shown in FIG. 3.

The following conditions were employed regarding sheets of paper.

Type of paper: Minolta CF80

Sheet size: A4R

Mode: Continuous double-sided full-color copy

Environment: 30° C., 80% RH

The total number of copies: 10,000 sheets b. The Evaluation Results

They are shown in Table 2.

TABLE 2

| Residual toner storage portion | Residual toner resupply | Edge damage ratio (%) |
|---|---|---|
| Not applied | Not applied | 42 |
| Applied | Not applied | 18 |
| Applied | Applied | 6 |

As a result, by means of rubbing of intermediate image transfer belt 6 against the residual toner in residual toner storage portion S, the damage to edge 812A of cleaning blade 812 was dramatically decreased. Resupply of residual toner by flicker 815 further decreased damage to edge 812A.

[Item 3] Occurrence of Leakage of Toner Slipping under the Cleaning Blade in the Endurance Test a. The Evaluation Method The leakage of toner slipping under edge 812A of cleaning blade 812 was evaluated during an endurance test if residual toner storage portion S was installed or not, as well as if residual toner was resupplied with flicker 815 or not. Rubbing length L was 5 mm.

The following conditions were employed regarding sheets of paper.

Type of paper: Minolta CF 80, Konica color paper, Konica 55 kg and Konica NRA100 (100% recycled paper)

Sheet size: 270,000 sheets of A4 and 30,000 sheets of A4R

Mode: 1,500 sheets of continuous double-sided copy, 900 sheets of continuous one-sided copy and 100 sheets of intermittent one-sided single copy were repeated. All of them were full color copies.

Image print ratio: The ratio was varied at five steps within 3-30%.

Environment: 120,000 sheets at normal temperature and normal humidity of 20° C. and 50% RH, 90,000 sheets at high temperature and high humidity of 30° C. and 80% RH, and 90,000 sheets at low temperature and low humidity of 10° C. and 20% RH b. The Evaluation Results They are shown in Table 3.

TABLE 3

| | Number of sheets (× 1000) | | | | | | | |
|---|---|---|---|---|---|---|---|---|
| | 20 | 50 | 70 | 100 | 150 | 200 | 250 | 300 |
| No residual toner storage portion No residual toner resupply | A | A | A | B | B | B | B | B |
| With residual toner storage portion No residual toner resupply | A | A | A | A | A | A | B | B |
| With residual toner storage portion With residual toner resupply | A | A | A | A | A | A | A | A |

A: No leakage of toner was observed.
B: Obvious leakage of toner was observed.

As a result, by means of rubbing of intermediate image transfer belt 6 against the residual toner accumulated in residual toner storage portion S, the durability was dramatically improved without leakage of toner slipping under the cleaning blade before 200,000 sheets had been copied. With resupply of the residual toner by flicker 815, the durability was further improved without leakage of toner slipping under the cleaning blade before 300,000 sheets had been copied.

[Item 4] Occurrence of Filming in the Endurance Test a. The Evaluation Method

It was the same as for Item 3.

b. The Evaluation Results

There are shown in Table 4.

TABLE 4

| | Number of sheets (× 1000) | | | | | | | |
|---|---|---|---|---|---|---|---|---|
| | 20 | 50 | 70 | 100 | 150 | 200 | 250 | 300 |
| No residual toner storage portion No residual toner resupply | A | B | B | B | B | B | B | B |
| With residual toner storage portion No residual toner resupply | A | A | A | A | A | A | B | B |
| With residual toner storage portion With residual toner resupply | A | A | A | A | A | A | A | A |

A: No filming was observed.
B: Obvious filming was observed.

As a result, by means of rubbing of intermediate image transfer belt 6 against the residual toner accumulated in residual toner storage portion S, the durability was dramatically improved without filming before 200,000 sheets had been copied. With resupply of residual toner by flicker 815, the durability was further improved without filming before 300,000 sheets had been copied.

What is claimed is:

1. An image forming apparatus, comprising:

an image carrier to carry a toner image formed based on image data, a cleaning blade to remove residual toner on the image carrier by being in contact with the image carrier at a first contacting point, a first roller which is in contact with the image carrier on an upstream side of the first contacting point in a rotational direction of the image carrier, the first roller having a property which does not cause magnetic force with the toner, and a toner storage portion structured to store the residual toner removed by the cleaning blade and to rub the image carrier with the stored residual toner, wherein the toner storage portion is located on an upstream side of the first contacting point in the rotational direction of the image carrier and the image carrier and the first roller form a part of a wall of the toner storage portion, and wherein a space area is maintained on the image carrier so that the stored residual toner in the toner storage portion does not rub the image carrier, between the first contacting point and a second contacting point, the second contacting point being a contacting point between the image carrier and an upper surface of the stored residual toner in the toner storage portion.

2. The image forming apparatus of claim 1, wherein a rubbing length in which the stored residual toner in the toner storage portion rubs on the image carrier is longer than or equal to 3 mm in the rotational direction of the image carrier.

3. The image forming apparatus of claim 1, further comprising:

a stored residual toner supplying device to make the stored residual toner in the toner storage portion adhere to the space area.

4. The image forming apparatus of claim 3, wherein the stored residual toner supplying device sprinkles the stored residual toner in the toner storage portion onto the space area.

5. The image forming apparatus of claim 4, wherein the stored residual toner supplying device, comprises, a brush roller which rotates while a part of the brush roller is in contact with the stored residual toner in the toner storage portion and a plate member to sprinkle the stored residual toner adhering to the brush roller.

6. The image forming apparatus of claim 1, wherein the image carrier is an intermediate image transfer belt.

7. The image forming apparatus of claim 6, further comprising: a second roller opposing the first roller, and the first and second rollers pinch the intermediate image transfer belt.

8. The image forming apparatus of claim 6, wherein the first roller rotates following a rotational direction of the intermediate image transfer belt.

9. An image forming apparatus, comprising:

an image carrier to carry a toner image formed based on image data, a cleaning blade to remove residual toner on the image carrier by being in contact with the image carrier at a first contacting point, a first roller which is in contact with the image carrier on an upstream side of the first contact point in a rotational direction of the image carrier, and a toner storage portion having two side walls and a bottom wall so as to form a trough shaped container to store the residual toner removed by the cleaning blade and to rub the image carrier by the stored residual toner, wherein the toner storage portion is located on an upstream side of the first contacting point in the rotational direction of the image carrier and the image carrier forms one of the two side walls and the first roller form the bottom wall of the toner storage portion.

* * * * *